United States Patent [19]

Kinnebrew, II et al.

[11] Patent Number: 4,875,348

[45] Date of Patent: Oct. 24, 1989

[54] THREAD DYEING APPARATUS AND METHOD

[75] Inventors: Earl Kinnebrew, II; Paul D. Palmer, Sr., both of Edmond, Okla.

[73] Assignee: Rhema Enterprises, Inc., Edmond, Okla.

[21] Appl. No.: 183,687

[22] Filed: Apr. 19, 1988

Related U.S. Application Data

[63] Continuation-in-part of Ser. No. 55,413, May 27, 1987.

[51] Int. Cl.[4] ..... D06B 1/12

[52] U.S. Cl. ..... 68/200; 112/270; 118/264; 118/268

[58] Field of Search ..... 112/79 A, 270; 68/200; 118/77, 264, 268

[56] References Cited

U.S. PATENT DOCUMENTS

| | | | |
|---|---|---|---|
| 1,953,863 | 4/1934 | Morrell | 68/200 UX |
| 2,310,764 | 2/1943 | Denhof . | |
| 2,325,129 | 7/1943 | Hardy | 68/200 |
| 2,675,755 | 4/1954 | Hall . | |
| 2,800,779 | 7/1957 | Karl . | |
| 2,910,026 | 10/1959 | Ajouelo | 112/270 |
| 3,098,373 | 7/1963 | Langston | 68/200 X |
| 3,098,374 | 7/1963 | Langston | 68/200 X |
| 3,291,097 | 12/1966 | Atkins et al. . | |
| 3,948,194 | 4/1976 | Gunold . | |
| 4,015,550 | 4/1977 | Bartenfeld et al. . | |
| 4,254,645 | 3/1981 | Kouris . | |
| 4,465,005 | 8/1984 | Eguchi et al. . | |
| 4,538,535 | 9/1985 | Hanyu et al. . | |

*Primary Examiner*—Frankie L. Stinson

*Attorney, Agent, or Firm*—Dunlap, Codding, Peterson & Lee

[57] ABSTRACT

The present invention comprises a thread dyeing apparatus and method for dyeing a thread. The apparatus comprises a marker having a transorb material and a nib with dyeing liquid being disposed in the marker housing as passing through the transorb material to the nib. A slit is formed in the nib. The slit is sized so the thread extends through the slit in the nib wherein the dyeing liquid is applied to the thread. In one embodiment, the apparatus is used to dye thread during operation of a sewing machine and, in this embodiment, the marker is positioned between the thread source and the needle of the machine. In other embodiment, the apparatus is utilized for applying a thread lubricant to the thread.

10 Claims, 3 Drawing Sheets

THREAD DYEING APPARATUS AND METHOD

CROSS-REFERENCE TO RELATED APPLICATIONS

The present application is a continuation-in-part of Applicants co-pending application entitled "Thread Dyeing Apparatus and Method", Ser. No. 055,413, filed May 27, 1987, pending, and owned by the Assignee of the present invention.

FIELD OF THE INVENTION

The present invention relates generally to a thread dyeing apparatus and method, and more particularly, but not by way of limitation, to an apparatus and method for dyeing thread using a marker comprising transorb material and a nib wherein the thread passes through the nib and dyeing liquid is applied to the thread through the nib.

BRIEF DESCRIPTION OF THE DRAWINGS

FIG. 8 is a partial schematic, partial cross sectional view of a modified support housing for use with a plurality of markers wherein each of the markers is constructed like the markers shown in FIGS. 6 and 7.

FIG. 9 is an elevational, schematic view of the dye applying apparatus shown in FIG. 2 for use in one other application for applying dyeing liquid to a material.

BRIEF DESCRIPTION OF THE PREFERRED EMBODIMENTS

In the textile and garment industries, and in home and commerical sewing applications, there often is a need for changing the color of thread. This need arises, for example, in the weaving of multi-colored fabrics and in sewing garments which include different colors of fabrics and in applying contrasting top stitching. For efficient production of such fabrics and garments, large inventories of different colored threads must be maintained. Also, the time required to frequently rethread machines leads to high labor cost, and thus increased production and product costs. The present invention provides a way for applying a dyeing liquid to thread which reduces the time and labor in changing thread colors. In so doing, the present invention improves the efficiency and decreases the expense of commercial textile and garment manufacturing. The private individual who sews also will appreciate the convenience invention.

The present invention comprises a dye applying apparatus for dyeing a thread. As used herein, the term "thread" includes any filamentous material such as commonly referred to as ribbon, tape, cord, twine or yarn. Also, the term "thread source" as used herein refers to any item by which thread is stored or dispensed, or both, such as spools, skeins, reels and the like.

Figure 1:
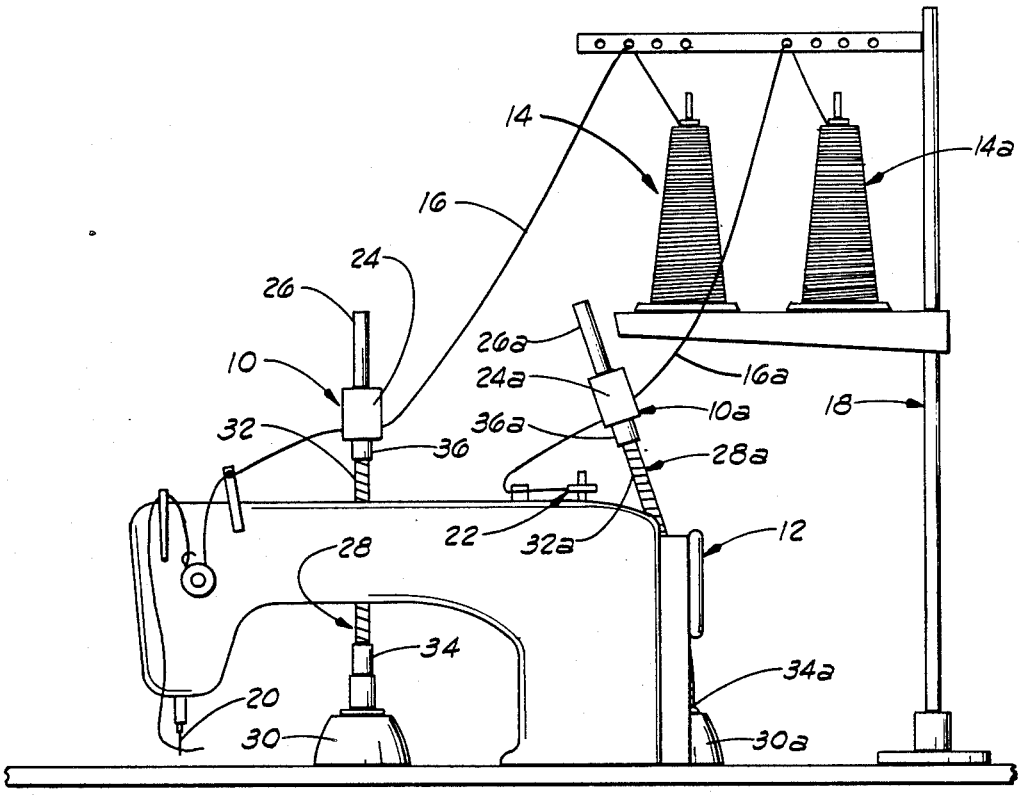
FIG. 1 is an elevational view of a sewing machine with a dye applying apparatus constructed in accordance with the present invention associated therewith. In the embodiment shown in FIG. 1, two dye applying apparatuses are associated with the sewing machine assembly.

Shown in FIG. 1 is a dye applying apparatus 10 which is constructed in accordance with the present invention and operatively associated with a conventional sewing machine 12. A thread source 14 in the form of a spool adapted for storing and dispensing a thread 16 is supported on a stand 18 generally above the sewing machine 12. The thread 16 is extended from the thread source 14 and operatively connected through the sewing machine to a needle 20. The sewing machine 12, the thread source 14 and the stand 18 all are intended to represent commercially available sewing machines and sewing machine accessories adapted for applying or sewing thread to a cloth in a conventional manner.

The dye applying apparatus 10 is disposed generally between the thread source 14 and the needle 20 of the sewing machine 12 and the thread 16 is operatively passed through the dye applying apparatus 10 during the operation of the sewing machine 12. In accordance with the present invention, the thread source 14 is adapted to supply a single color, white, thread 16. The dye applying apparatus 10 is adapted to receive the thread 16 and apply a dyeing liquid to the thread 16 for dyeing the thread 16 a predetermined color. The dyed thread 16 is passed from the dye applying apparatus 10 to the needle 20 where the dyed thread is applied or sewed to the cloth in a conventional manner. The dye applying apparatus 10 of the present invention particularly is constructed so that the color of the dyeing liquid can be changed in a fast and convenient manner thereby permitting an individual to change the color of the dyed thread 16 at any time in a fast and convenient manner.

In the embodiment of the invention shown in FIG. 1, the sewing machine 12 also includes a second thread source **14*a* supported on the stand 18 with a second thread 16*a* being dispensed from the second thread source 14*a*. The sewing machine 12 includes a bobbin winder 22 which is adapted to wind thread into a bobbin for use with the sewing machine 12 in a manner well known in the art. In this embodiment, the thread 16*a* extends from the thread source 14*a* to the bobbin winder 22 and the thread 16*a* is wound onto the bobbin by the bobbin winder 22 during the operation of the sewing machine 12**.

A second dye applying apparatus **10*a* is disposed between the thread source 14*a* and the bobbin winder 22. The second thread 16*a* is passed from the thread source 14*a* through the dye applying apparatus 10*a* to the bobbin winder 22 during the operation of the sewing machine. The second dye applying apparatus 10*a* applies a dyeing liquid to the thread 16*a* for dyeing the thread a predetermined color. Thus, the thread 16*a* wound onto the bobbin by the bobbin winder 22 is dyed a predetermined color by the dye applying apparatus 10*a* in an automatic manner during the operation of the sewing machine 12. In manner like the thread source 14 described before, the thread source 14*a* stores and dispenses a source of white thread with the dye applying apparatus 10***a* dyeing the white thread a predetermined color during the operation of the sewing machine 12.

The dye applying apparatus 10*a* is constructed and operates exactly like the dye applying apparatus 10, except the dye applying apparatus 10*a* is utilized in this application to dye thread for a bobbin. The below description of the dye applying apparatus 10 and thread 16 applies equally to the dye applying apparatus 10*a* and the thread 16*a*, with the single exception that the dye applying apparatus 10*a* is operatively associated with the bobbin winder 22.

Figure 2:
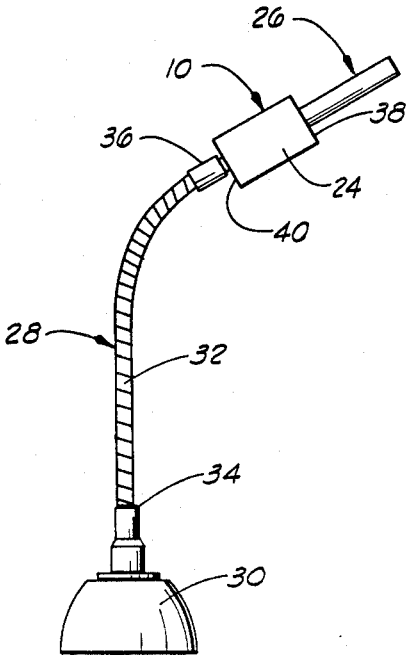
FIG. 2 is a side elevational view of one of the dye applying apparatuses shown in FIG. 1.

As shown in FIG. 2, the dye applying apparatus 10 includes a support housing 24 with a marker 26 operatively supported within the support housing 24. In this particular embodiment, the support housing 24 is supported generally on a support stand 28.

The support stand 28 includes a stand base 30 which is adapted to be operatively disposed on a support surface and a pliable neck 32. The pliable neck 32 has a first end 34 which is connected to the stand base 30 and an opposite second end 36 which is removably connected to the support housing 24. The pliable neck 32 is adapted to be positioned in various positions by twisting and angularly moving the pliable neck 32 for selectively positioning the support housing 24 in preselected positions.

The pliable neck 32 may be constructed of any bendable metal and preferably is of the type commonly referred to in the art as a "goose neck" type of construction.

The above-described support stand 28 is a one means for positioning the support housing 24 at preselected positions generally above the support stand 28. It is to be understood, however, that other suitable means may be employed to support and position the support housing 24. For example, in some commercially available sewing machines (not shown) where the thread spools are mounted on top of the machine, it may be desirable to attach the support housing directly to the top of the machine utilizing a commercially available self-gripping fastener of the type commonly referred to as "Velcro".

Figure 3:
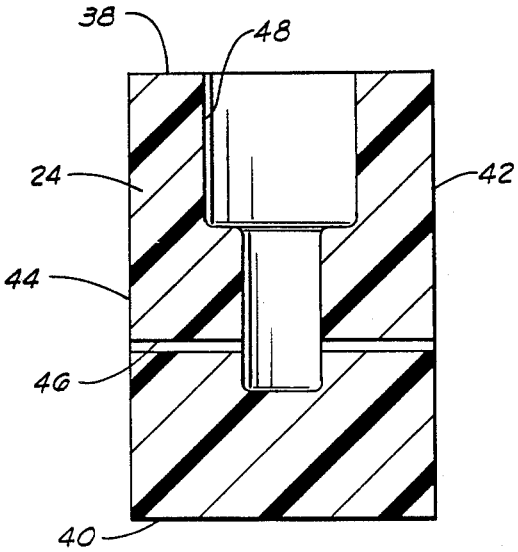
FIG. 3 is a sectional view of a support housing portion of the dye applying apparatus of the present invention.
Figure 4:
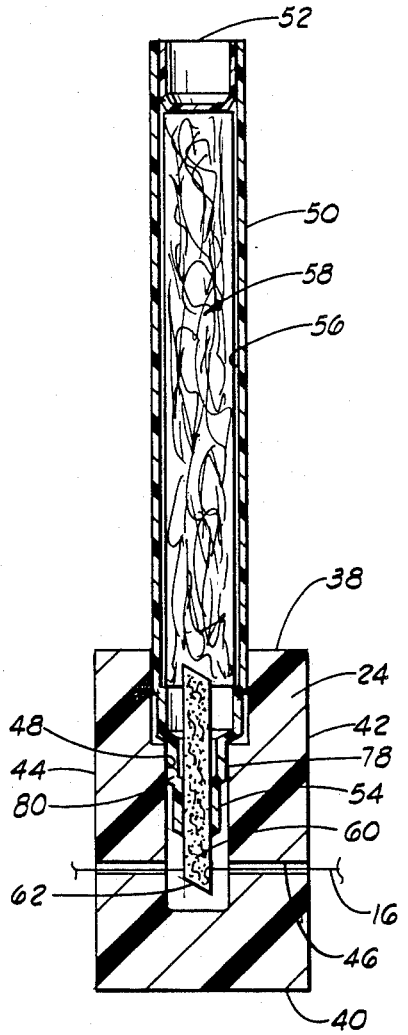
FIG. 4 is a sectional view of the support housing shown in FIG. 3 with a marker constructed in accordance with the present invention operatively disposed therein.

As shown more clearly in FIGS. 3 and 4, the support housing 24 is generally rectangularly shaped and includes a first end 38, a second end 40, a first side 42 and a second side 44. A thread opening 46 is formed through the support housing 24 and the thread opening 46 extends through the support housing 24 intersecting the first and the second sides 42 and 44 thereof.

The thread opening 46 is sized for receiving the thread 16 to be dyed so that the thread 16 may be moved rapidly through the thread opening 46 during the operation of the sewing machine 12. The thread opening 46 preferably has a diameter larger than the diameter of the thread 16 to provide clearance therebetween. In the preferred embodiment, the thread opening 46 only is slightly larger than the thread 16 to reduce evaporation of the dyeing liquid through the thread opening 46. Also, the surface of the thread opening 46 preferably is smoothed throughout its length to faciliate the movement of the thread 16 therethrough.

The support housing 24 includes a housing opening 36 formed through and intersecting the first end 38 thereof. The housing opening 48 extends a distance through the support housing 24 and intersects the thread opening 46. The housing opening 48 is adapted to receive a portion of the marker 26 for cooperating to support the marker 26 in a connected position to the support housing 24.

As shown more clearly in FIG. 4, the marker 26 comprises a marker container 50 having an upper end 52 and a lower end 54. A marker opening 56 extends a distance through the marker container 50 and intersects the lower end 54 of the marker container 50. A transorb material 58 is disposed in the marker opening 56. One end of a nib 60 extends a distance through a portion of the transorb material 58, generally near the lower end 54 of the marker container 50. The nib 60 extends a distance out from the lower end 54 of the marker container 50 terminating with a tip end 62 of the nib 60.

A dyeing liquid is disposed in the marker opening 56 generally about and within the transorb material 58. The transorb material 58 functions to store the dyeing liquid and the transorb material 58 cooperates with the nib 60 to control the flow of the dyeing liquid from the transorb material 58 through the nib 60 so dyeing liquid is available throughout the nib and particularly at the tip end 62 of the nib 60.

Markers of the type generally described before with respect to the marker 26 which include transorb material and a nib, like the transorb material 58 and the nib 60, are commercially available from such sources as Eberhard-Faber of Wilkes-Barre, Pa. and sold under their mark "MARKETTE". One feature of the present invention is the use of existing markers of the type just described for dyeing thread.

As presently available, such commercial markers of the type described before generally contain a dyeing liquid for marking on paper or similar material. This particular dyeing liquid generally has a drying time sufficiently long so that some of the dyeing liquid on the thread bleeds onto the cloth when used in a sewing machine application of the type described herein in conjunction with the dye applying apparatus 10. In other words, the drying time of the dyeing liquid in commercially available markers has been found in general to be to long for the applications contemplated herein to achieve the most desired results.

It is desirable to substitute the dyeing liquid generally in such commercially available markers for a dyeing liquid having a shorter drying time so the dyeing liquid will fix to the thread before the thread is applied to the cloth to substantially prevent the bleeding of the dyeing liquid onto the cloth. The following dyeing liquids, commonly referred to in the art as solvent dyes, have been found to have a sufficiently short drying time so that the dyeing liquid is fix to the thread before the thread engages the cloth and such compounds have been found useful in conjunction with the present invention as the dyeing liquid in the marker 26.

| | |
|---|---|
| Dyeing Liquid No. 1 | |
| Neopen Blue 808 | 0.18% |
| CK2432 Resin | 8.00% |
| N—Propanol | 91.82% |
| | 100.00% |
| Dyeing Liquid No. 2 | |
| Iosol Red | 6.0% |
| CK2432 Resin | 12.0% |
| N—Propanol | 82.0% |
| | 100.0% |
| Dyeing Liquid No. 3 | |
| Neopen Blue 808 | 3.90% |
| Iosol Orange | 0.05% |
| CK2432 | 10.00% |

-continued

| | |
|---|---|
| N—Propanol | 86.05% |
| | 100.00% |
| Dyeing Liquid No. 4 | |
| Neopen Blue 808 | 6.40% |
| Ceres Blue ZV | 1.60% |
| Interplast or Orosol 2 GLN | 0.06% |
| CK2432 Resin | 10.00% |
| N—Propanol | 81.94% |
| | 100.00% |
| Dyeing Liquid No. 5 | |
| Neopen Red 336 | 2.0% |
| Interplast or Orosol Yellow 2 GLN | 4.0% |
| Neopen Blue 808 | 0.4% |
| CK2432 Resin | 10.0% |
| N—Propanol | 83.6% |
| | 100.0% |
| Dyeing Liquid No. 6 | |
| Neopen Red 336 | 0.07% |
| Interplast or Orosol Yellow 2 GLN | 0.18% |
| Neopen Blue 808 | 0.04% |
| CK2432 Resin | 10.00% |
| N—Propanol | 89.71% |
| | 100.00% |
| Dyeing Liquid No. 7 | |
| Neopen Blue 808 | 6.0% |
| Interplast or Orosol Yellow 2GLN | 1.1% |
| CK2432 Resin | 10.0% |
| N—Propanol | 82.9% |
| | 100.0% |
| Dyeing Liquid No. 8 | |
| Interplast or Orosol Black RL | 0.20% |
| CK2432 Resin | 10.00% |
| N—Propanol | 89.80% |
| | 100.00% |
| Dyeing Liquid No. 9 | |
| Neopen Red 336 | 2.60% |
| Interplast or Orosol Yellow 2GLN | 2.70% |
| Interplast Black RL | 0.25% |
| CK2432 Resin | 10.00% |
| N—Propanol | 84.45% |
| | 100.00% |
| Dyeing Liquid No. 10 | |
| Interplast or Orosol Black RL | 1.55% |
| CK2432 Resin | 10.00% |
| N—Propanol | 88.45% |
| | 100.00% |
| Dyeing Liquid No. 11 | |
| Interplast or Orosol Yellow 2GLN | 0.33% |
| Neopen Blue 808 | 0.13% |
| Interplast or Orosol RL | 0.03% |
| CK2432 Resin | 10.00% |
| N—Propanol | 89.46% |
| | 100.00% |
| Dyeing Liquid No. 12 | |
| Neopen Blue 808 | 3.90% |
| Isol Orange | 0.05% |
| CK2432 | 15.00% |
| N—Propanol | 81.05% |
| | 100.00% |
| Dyeing Liquid No. 13 | |
| Neopen Blue 808 | 0.18% |
| CK2432 | 15.00% |
| N—Propanol | 84.82% |
| | 100.00% |
| Dyeing Liquid No. 14 | |
| Neopen Blue 808 | 6.40% |
| Ceres Blue 2N | 1.60% |
| Orosol Yellow 2GLN | 0.06% |
| CK2432 | 15.00% |
| N—Propanol | 76.94% |
| | 100.00% |
| Dyeing Liquid No. 15 | |
| Neopen Red 336 | 2.0% |
| Interplast or Orosol Yellow 2GLN | 4.0% |
| Neopen Blue 808 | 0.4% |
| CK2432 | 15.0% |

-continued

| | |
|---|---|
| N—Propanol | 78.6% |
| | 100.0% |
| Dyeing Liquid No. 16 | |
| Neopen Red 336 | 2.60% |
| Interplast or Orsol | 2.70% |
| Orosol Black RL | 0.25% |
| CK2432 | 15.00% |
| N—Propanol | 79.45% |
| | 100.00% |
| Dyeing Liquid No. 17 | |
| Neopen Red 336 | 0.07% |
| Interplast or Orosol Yellow 2GLN | 0.18% |
| Neopen Blue 808 | 0.04% |
| CK2432 | 15.00% |
| N—Propanol | 84.71% |
| | 100.00% |
| Dyeing Liquid No. 18 | |
| Iosol Red | 6.0% |
| CK2432 | 15.0% |
| N—Propanol | 79.0% |
| | 100.0% |
| Dyeing Liquid No. 19 | |
| Neopen Blue 808 | 6.0% |
| Orosol or Interplast Yellow 2GLN | 1.1% |
| CK2432 | 15.0% |
| N—Propanol | 77.9% |
| | 100.0% |
| Dyeing Liquid No. 20 | |
| Interplast or Orosol Yellow 2GLN | 0.33% |
| Neopen Blue 808 | 0.18% |
| Interplast or Orosol Black RL | 0.03% |
| CK2432 Resin | 15.00% |
| N—Propanol | 84.46% |
| | 100.00% |
| Dyeing Liquid No. 21 | |
| Interplast or Orosol Black RL | 1.5% |
| CK2432 | 15.0% |
| N—Propanol | 83.5% |
| | 100.0% |
| Dyeing Liquid No. 22 | |
| Interplast or Orosol Black RL | 0.20% |
| CK2432 | 15.00% |
| N—Propanol | 84.80% |
| | 100.00% |

In general, the solvent dyeing liquids found to be useful in the present invention comprise: a phenolic resin in the range of from about 10% to about 15% by weight, a carrier, n-propanol alcohol, in a range from about 75% to about 89.5% by weight and a solvent dye in a range from about 0.5% to about 10%.

The phenolic resin is made of phenolpuliminized formaldehyde such as commercially available fron Union Carbide sold as their phenol resin CK2432. Other resins such as a ketone resin or a nylon resin also may be useful.

The carrier in the above liquid solvent dyes is n-propanol alcohol. Also the carrier could be xylene or other types of alcohols, glycols or water.

The dyes in the solvent liquid dyes are soluble in alcohols or xylene.

In markers of the type described herein as the marker 26, the dyeing liquid flows from the transorb material 58 through the nib 60 by capillary action in a controlled manner. The resin is selected so as to not block this flow through the marker 26. In general, the more resin in the dyeing liquid the faster the drying time. However, increasing the amount of resin also increases the viscosity of the dyeing liquid. For example, a dyeing liquid with 40% resin will not flow through the marker 26. The resin functions as a binding agent which allows the dyeing liquid to bind to the surface of the thread.

The above dyeing liquid formulas are not suitable for dry cleaning applications where the thread will be subjected to commercial dry cleaning procedures. Solvent dyes of this type tend to washout during such drying cleaning procedures.

As shown in FIGS. 3 and 4, the housing opening 48 is adapted for supporting the marker container 50 so that, when the marker container 50 is positioned in the housing opening 48, the nib 60 is disposed in the housing opening 48 intersecting a portion of the thread opening 46 and is positioned for engaging the thread 16 as the thread 16 is moved through the thread opening 46. In this manner, as the thread 16 is moved through the thread opening 46, the thread 16 is engaged by the nib 60 for applying dyeing liquid to the thread 16 as the thread 16 moves through the support housing 24.

Figure 5:
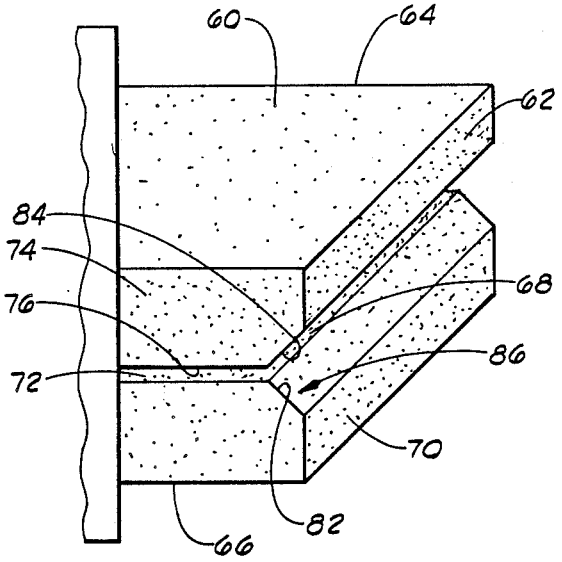
FIG. 5 is an enlarged perspective view of the nib of the marker constructed in accordance with the present invention.

As shown more clearly in FIGS. 4 and 5, the nib 60 of the marker 26 has a first side 64 and a second side 66. A slit 68 is formed in the tip end 62 of the nib 60. The slit 68 intersects the tip end 62 and the first and the second sides 64 and 66, and the slit 68 extends a distance from the tip end 62 of the nib 60 into the nib 60.

The slit 68 divides the tip end 62 portion of the nib 60 into a first nib portion 70 having a face 72 formed by the slit 68 and a second nib portion 74 having a face 76 formed by the slit 68. The face 72 of the first nib portion 70 faces the face 76 of the second nib portion 74, and the faces 72 and 76 are disposed generally adjacent each other. In other words, the slit 68 preferably has an extremely small width. The slit 68 has a width less than the diameter of the thread and is sized and positioned so that, when the thread is disposed in the slit 65, portions of the nib 60 extend generally above and below the thread for substantially assuring that the dyeing liquid is applied to the thread generally about the entire circumference of the thread. In one model, the slit 68 was formed by taking a razor blade and cutting the tip end 62 of the nib 60 thereby forming the slit 68 with the removal of only a negilible amount of nib 60 material.

When the marker 26 is disposed in the support housing 24, the marker 26 is oriented so that the slit 68 generally is aligned with the thread opening 46. In this manner, the thread 16 will move through the thread opening 46 and pass through the slit 68.

To reduce the rate of evaporation and increase the life of the marker 26, a seal preferably is formed between the marker container 50 and the support housing 24. More particularly, the marker container 50 and the support housing 24 are formed so that a seal is created when the marker 26 is removeably inserted into the housing opening 48 and the support housing 24.

As shown in FIG. 4, the marker container 50 includes an outer peripheral surface 78 and the housing opening 48 is formed in the complimentary shape. In this manner, the portions of the support housing 24 formed by the housing opening 48 will sealingly engage the outer peripheral surface 78 of the marker container 50 when the marker container 50 is inserted into the housing opening 48.

A protrusion 80 is formed on one end of the marker container 50 from which the nib 60 extends, so that the nib 60 extends from the protrusion 80. The housing opening 48 includes a portion adapted to sealing engage the outer peripheral surface 78 of the protrusion 80 upon insertion of the marker container 50 protrusion 80 into the housing opening 48.

In operation, the dye applying apparatus 10 is positioned generally between the thread source 14 and the point of application of the thread 16, or, in other words, the needle 20. The thread 16 is extended from the thread source 14 and is inserted through the thread opening 46 in the support housing 24. The thread is threaded through the thread opening 46 and passed from the thread opening 46 to the sewing machine 12.

The nib 60 end portion of the marker 26 is then inserted into the housing opening 48 in the support housing 24. The marker is oriented so that the slit 68 of the marker 26 generally is aligned with the thread opening 46. As the marker 26 is moved into the housing opening 48, the nib 60 is moved generally about the thread 16 with the thread 16 being disposed within the slit 68 in the nib 60.

As the thread is moved through the thread opening 46 during the operation of the sewing machine 12, dyeing liquid is applied from the nib 60 to the thread 16 thereby dyeing the thread 16.

As shown in FIG. 5, a tapered portion 82 is formed in the face 72 of the first nib portion 70, generally adjacent the tip end 62. A tapered portion 84 is formed in the face 76 of the second nib portion 74 generally near the tip end 62. The tapered portion 82 generally faces the tapered portion 84 and the tapered portions 82 and 84 cooperate to form a thread guide channel 86. The thread guide channel 86 is positioned generally near the tip end 62 of the nib 60 and the thread guide channel 86 is positioned generally adjacent the slit 68 so that the thread guide channel 86 forms a guide for guiding the threads 16 into the slit 68. The thread guide channel 86 has a width at the tip end 62 of the nib 60 which is greater than the width of the slit 68 and greater then the diameter of the thread for assisting in guiding the thread into the slit 68.

The support housing 24 preferably is oriented to support the marker 26 in a position so that the nib 60 generally faces in a downward direction. The purpose of facing the marker 26 so that the nib 60 is disposed generally in a downwardly facing direction is to faciliate the flow of dyeing liquid through the transorb material 58 and into the nib 60 during the operation of the dye applying apparatus 10.

In some instances, the passing of the thread 16 through the slit 68 tends to wear the adjacent portions of the faces of 72 and 76 thereby forming what may be referred to as a wear opening in the faces 72 and 76. In this instances, the marker container 50 may be rotated slightly so that the slit 68 is not quite aligned with the thread opening 46 thereby bringing the thread 16 into a more engaging position with the faces 72 and 76 of the nib 60 to facilitate the applying of the dyeing liquid to the thread 16 as the thread 16 moves through the dye applying apparatus 10.

The present invention, in one aspect, provides a new use for markers of the type generally described before with the respect to the marker 26. In this aspect, the dye applying apparatus 10 utilizes expendable or throw-away markers 26 wherein, once the dyeing liquid has been expended, the marker 26 is simply discarded and a new marker 26 is inserted into the support housing 24. The use of expendable markers of this type eliminates any need for re-filling dye containers or the like and eliminates any mess which might be associated with the re-filling of such dye containers.

In addition, the dye applying apparatus 10 is completely portable. The dye applying apparatus is not permanently or removably affixed to the sewing machine 12. Rather, the dye applying apparatus 10 is merely mounted near the sewing machine 12. Thus, the user can move the dye applying apparatus 10 to any location or the user can move the dye applying apparatus 10 to be used in conjunction with any sewing machine without disassembling the dye applying apparatus 10 from the previous sewing machine. In this manner, the user can use the dye applying apparatus 10 in connection with one sewing machine such as a "Serger" for example or on a multi-head machine, darner machine or monograming machine and the dye applying apparatus 10 may be used from machine to machine utilizing a single white thread source. The dye applying apparatus 10 thus particularly is useful in the completion of a project requiring several different machines to complete a single task such as hemming, blind stitching and button-holing, for example.

Although the dye applying apparatus 10 has been described before as being useful in connection with the sewing machine 12, the dye applying apparatus 10 could be used for dyeing thread in a weaving operation thereby allowing the user to establish a color pattern in the weaving process without changing thread from the thread source. Obviously, the dye applying apparatus 10 could be incorporated into a commercial weaving operation within the textile industry in a manner similar to that described before with respect to a whole new type of weaving operation.

Also, it should be noted that the dye applying apparatus 10 could be used in a commercial thread dyeing application for making different colored threads.

With respect to high speed sewing machines, it is common for a silicone lubricant to be applied to the thread as the thread is being passed to or through the sewing machine. In one aspect, the present invention contemplates substituting the dye applying liquid in the marker 26 with a silicone thread lubricating liquid and applying the thread lubricating liquid to the thread as the thread is moved through the dye applying apparatus 10 in a manner exactly like the dyeing liquid was applied to the thread in the manner described in detail before. The thread lubricating compound preferably is a cleaning type of lubricant so that the use of the dye applying apparatus 10 in connection with the cleaning lubricant would reduce or eliminate the need of dismantling tensioning devices to perform the cleaning of spindles for example thereby saving labor and time.

It also should be noted, that in lieu of utilizing the two dye applying apparatus 10 and 10*a*, a single dye applying apparatus 10 could be utilized. In this example, when one desired to dye the bobbin thread 16*a*, one would merely swivel the dye applying apparatus 10 into position so that the thread 16*a* could be passed into position so that the thread 16*a* could be passed through the dye applying apparatus 10.

Figure 6:
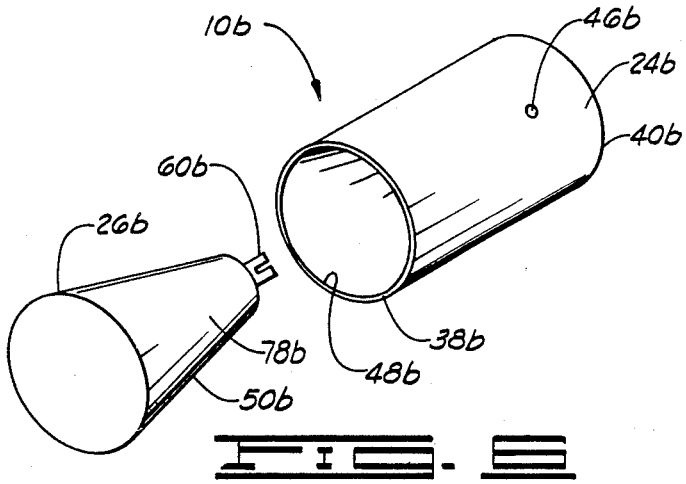
FIG. 6 is a perspective view of modified marker and a modified support housing constructed in accordance with the present invention.
Figure 7:
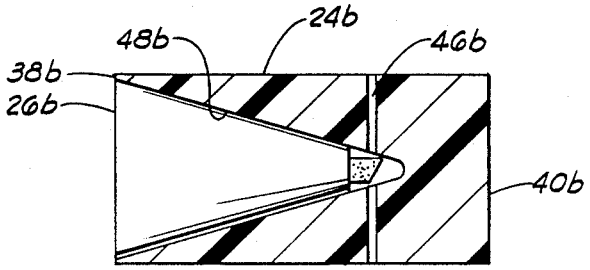
FIG. 7 is a sectional veiw of the modified marker and the modified support housing shown in FIG. 6.
Figure 3:
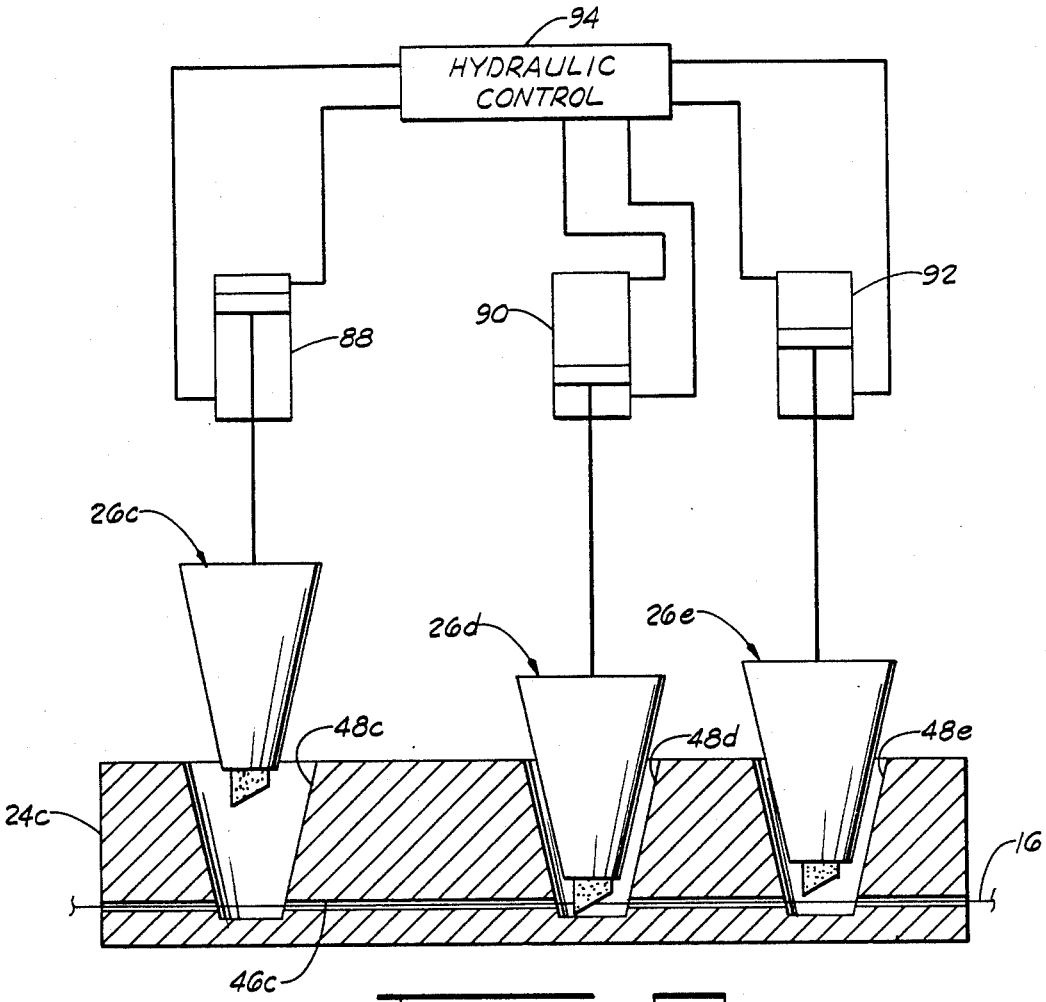
Figure 3:
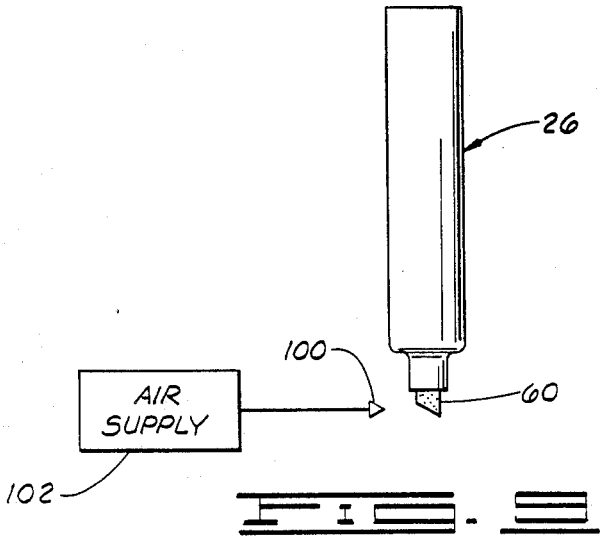

Shown in FIGS. 6 and 7 is a modified marker 26*b*. The modified marker 26*b* is constructed exactly like the marker 26 described in detail before, except the marker container 50*b* is conically shaped. In this embodiment, the support housing 24*b* is cylindrically shaped with a conically shaped housing opening 48*b* shaped for mateingly receiving the conically shaped marker container 50*b*.

To reduce evaporation of the dyeing liquid from the surface of the nib 60*b*, the marker container 50*b* and the housing opening 48*b* are formed to create a seal. In this regard, the outer peripheral surface 78*b* of the marker container 50*b* is shaped to mateingly and sealingly engage the portions of the support housing 24*b* formed by the housing opening 48*b*.

Shown in FIG. 8, is a modified support housing 24*b* which includes a plurality of housing openings, three housing openings being shown in FIG. 8 and designated therein by the reference numerals 48*c*, 48*d* and 48*e*. The housing openings 48*c*, 48*d* and 48*e* are formed exactly like the housing opening 48*b* shown in FIGS. 6 and 7 and described in detail before.

The embodiment of the invention shown in FIG. 8, includes a plurality of markers, three markers being shown in FIG. 8 and designated therein by the reference numerals 26*c*, 26*d* and 26*e*. The markers 26*c*, 26*d* and 26*3* are constructed exactly like the markers 26*b* shown in FIGS. 6 and 7 and described in detail before. The marker 26*c* is sized and positioned to be disposed in the housing opening 48*c*, the marker 26*d* is sized and positioned to be disposed in the housing opening 48*d* and the marker 26*e* is sized and positioned to be disposed in the housing opening 48*e*.

A hydraulic cylinder 88 is connected to the marker 26*c*, a hydraulic cylinder 90 is connected to the marker 26*d* and a hydraulic cylinder 92 is connected to the marker 26*e*. The hydraulic cylinders 88, 90 and 92 each are connected to a hydraulic control 94 which is adapted to control the positions of the hydraulic cylinders 88, 90 and 92.

In one position of the hydraulic control 94, the hydraulic cylinder 88 is actuated to dispose the marker 26*c* in the housing opening 48*c* and, in one other position, the hydraulic control 88 is positioned to actuate the hydraulic cylinder 88 to remove the marker 26*c* from the housing opening 48*c*.

In one position of the hydraulic control 94, the hydraulic cylinder 90 is actuated to dispose the marker 26*d* in the housing opening 48*d* and, in one other position, the hydraulic control 94 is positioned to actuate the hydraulic cylinder 90 to remove the marker 26*d* from the housing opening 48*d*.

In one position of the hydraulic control 94, the hydraulic cylinder 92 is actuated to dispose the marker 26*e* in the housing opening 48*e* and, in one other position, the hydraulic control 94 is positioned to actuate the hydraulic cylinder 92 to remove the marker 26*e* from the housing opening 48*e*.

Thus, in this embodiment, any one or more of the markers 26*c*, 26*d* or 26*e* may be positioned within the support housing 24*c* for engagement with the thread 16 as the thread 16 is moved through the housing opening 46*c*. It should be noted that hydraulic cylinders 88, 90 and 92 could be replaced with solenoid type control device for selectively positioning the markers 26*c*, 26*d* and 26*e*.

It also should be noted that the number of thread colors provided is not limited to the number of markers 26 so provided since more than one marker 26 can engage the thread at the same time to produce a color combination. For example, when a red marker and a yellow marker are both engage with the thread, the thread would be dyed an orange color.

Shown in FIG. 9 is one other application utilizing the marker 26. In this application, pressurized air from an air source 102 is passed through a nozzle 100 and through the nib 60 of the marker 26. The pressurized air forces dyeing liquid to be sprayed from the nib 60 for applying the sprayed dyeing liquid onto a material such as a cloth or paper or other such material.

The housing 24 could be incorporated as an integral part of a sewing machine or other such apparatus.

Changes may be made in the construction, operation and arrangement of the various parts, elements and assemblies described herein and changes may be made in the steps or sequence of steps of the methods described herein without departing from the spirit and scope of the invention as defined in the following claims.

We claim:

1. A dye applying apparatus for applying a dyeing liquid to a thread, comprising:

a marker comprising a marker container having an upper end and a lower end with a marker opening extending a distance therethrough intersecting the lower end thereof, a transorb material being disposed within the marker opening and a nib with a portion of the nib being disposed in the transorb material and the nib extending a distance out from the open end of the marker container terminating with a tip end, dyeing liquid being disposed in the marker opening and being transferred through the transorb material to the nib, a slit being formed in the tip end of the nib with a slit extending a distance through the nib, the slit being sized to accommodate a portion of the thread extending through the slit with portions of the nib formed by the slit being disposed generally adjacent the portions of the thread extending through the slit, the dye liquid being applied to the thread via the nib;

a support housing having a thread opening extending through a portion thereof, the thread opening being sized for receiving a thread so that the thread is movable therethrough, the support housing having a housing opening extending a distance through the support housing with a portion of the housing opening intersecting the thread opening, and wherein a portion of the marker is defined further as being supportable in the housing opening so nib is disposed within the housing opening, the thread being disposed in the slit in the nib as the thread is moved through the thread opening for applying dye to the thread; and a support stand having opposite ends with one end being adapted to be removably connectable to the support housing for supporting the support housing.

2. The dyeing apparatus of claim 1 wherein the nib is defined further as having a first side and a second side and wherein the the slit is defined further as intersecting the first and second sides of the nib and forming a first nib portion and a second nib portion, the first nib portion having a face formed by the slit and the second nib portion having a face formed by the slit, the face of the first nib portion facing and being disposed generally adjacent the face of the second nib portion and the space between the faces on the first and second nib portions forming the slit in the nib.

3. The dyeing apparatus of claim 2 wherein the first nib portion is defined further to include a tapered portion formed on the face of the first nib portion generally adjacent the tip end of the nib, and wherein the second nib portion is defined further to include a tapered portion formed on the face of the second nib portion generally adjacent the tip end of the nib, and the tapered portions formed on the first and second nib portions cooperating to form a thread guide channel adjacent the slit and adjacent the tip end of the nib for guiding the thread into the slit.

4. The dye applying apparatus of claim 1 defined further to include:

means for forming a seal between the marker container and the support housing when the marker is supported in the housing opening for reducing evaporation of the dyeing liquid.

5. The dyeing applying apparatus of claim 4 wherein the marker container is characterized by an outer peripheral surface, and wherein the housing opening in the support housing is characterized as being shaped to sealingly engage the outer peripheral surface of the marker container when the marker container is inserted in the housing opening.

6. The dye applying apparatus of claim 5 wherein the marker container has a protrusion with an outer peripheral surface, the protrusion being formed on the end of the marker container from which the nib extends; and wherein the nib extends from the protrusion; and wherein the housing opening includes a portion adapted to sealingly engage the outer peripheral surface of the protrusion when the marker container is inserted in the housing opening.

7. The dye applying apparatus of claim 1 wherein the thread opening has a diameter about the same diameter as the thread, yet slightly larger to permit the thread to be moved through the thread opening while maintaining a minimum clearance between the thread and the portion of the support housing formed by the thread opening to reduce evaporation of the dyeing liquid by way of the thread opening.

8. The dye applying apparatus of claim 1 wherein the support stand comprises:

a stand; and a pliable neck having a first end connected to the stand base and an opposite second end removably connectable to the support housing wherein the pliable neck is selectively positionable for positioning the support housing in pre-selected positions.

9. The dye applying apparatus of claim 8 adapted for use with a sewing machine having a needle for applying the thread during operation of the sewing machine, wherein the thread extends from a thread source to the needle, and wherein the dye applying apparatus further comprises:

means for supporting the marker between the thread source and the needle.

10. The dye applying apparatus of claim 9 wherein the dyeing liquid is characterized by a drying time sufficiently short so the dyeing liquid dries on the thread before the thread reaches the needle.

* * * * *

UNITED STATES PATENT AND TRADEMARK OFFICE

CERTIFICATE OF CORRECTION

PATENT NO. : 4,875,348

DATED : October 24, 1989

INVENTOR(S) : Kinnebrew, II, et al.

It is certified that error appears in the above-identified patent and that said Letters Patent is hereby corrected as shown below:

Column 2, line 3, after the word, convenience, please add --of fewer thread changes made possible by the present--.

Column 4, line 41, "to" should be --too--.

Column 10, line 15, "263" should be --26e--.

Signed and Sealed this

Seventh Day of May, 1991

*Attest:*

HARRY F. MANBECK, JR.

*Attesting Officer*

*Commissioner of Patents and Trademarks*